US009990893B2

(12) United States Patent
Lin et al.

(10) Patent No.: US 9,990,893 B2
(45) Date of Patent: Jun. 5, 2018

(54) PIXEL CIRCUIT

(71) Applicant: AU OPTRONICS CORP., Hsin-Chu (TW)

(72) Inventors: Chih-Lung Lin, Hsin-Chu (TW); Jian-Shen Yu, Hsin-Chu (TW); Fu-Hsing Chen, Hsin-Chu (TW); Chia-Che Hung, Hsin-Chu (TW); Ze-yu Yen, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 62 days.

(21) Appl. No.: 15/012,303

(22) Filed: Feb. 1, 2016

(65) Prior Publication Data

US 2017/0053611 A1 Feb. 23, 2017

(30) Foreign Application Priority Data

Aug. 20, 2015 (TW) ..... 104127188 A

(51) Int. Cl.
*G09G 3/36* (2006.01)

(52) U.S. Cl.
CPC ..... *G09G 3/3648* (2013.01); *G09G 3/3614* (2013.01); *G09G 2300/0852* (2013.01); *G09G 2310/0251* (2013.01); *G09G 2320/0252* (2013.01)

(58) Field of Classification Search
CPC ..... G09G 3/3648; G09G 3/3614; G09G 2320/0252
See application file for complete search history.

(56) References Cited

U.S. PATENT DOCUMENTS 6,072,454 A * 6/2000 Nakai ..... G02F 1/1368 345/97
7,079,101 B1 * 7/2006 Asada ..... G09G 3/3648 345/87
2002/0024511 A1 * 2/2002 Ozawa ..... G09G 3/2011 345/204
2002/0093472 A1 * 7/2002 Numao ..... G09G 3/3258 345/87
2008/0079676 A1 * 4/2008 Pak ..... G09G 3/3677 345/87
2008/0170022 A1 * 7/2008 Chen ..... G09G 3/3648 345/92
2009/0040414 A1 * 2/2009 Kawachi ..... G09G 3/2011 349/48

(Continued)

*Primary Examiner* — Claire X Pappas
*Assistant Examiner* — Robert Stone
(74) *Attorney, Agent, or Firm* — WPAT, PC

(57) ABSTRACT

A pixel circuit includes a first capacitor whose two terminals are coupled to a first node and a ground end respectively, a first switch whose two terminals are coupled to a second node and a fourth node respectively, a liquid crystal, a second switch, a pull-up circuit, a pull-down circuit, a second capacitor and a third switch. The first switch is coupled to the first node and a first data input end. The liquid crystal is coupled to the second and a third node. The second switch is coupled to the second node and a second data input end. The pull-up circuit is coupled to the first node and the second node and a node of a high voltage. The pull-down circuit is coupled to the second node, the fourth node and the ground end. The third switch is coupled to the fourth node and the ground end.

8 Claims, 5 Drawing Sheets

(56) References Cited

U.S. PATENT DOCUMENTS

| | | | | |
|---|---|---|---|---|
| 2010/0177082 | A1* | 7/2010 | Joo | G09G 3/3677 345/211 |
| 2011/0090196 | A1* | 4/2011 | Li | G09G 3/3648 345/209 |
| 2012/0019503 | A1* | 1/2012 | Lee | G09G 3/3659 345/211 |
| 2014/0078127 | A1* | 3/2014 | Lin | G09G 3/3659 345/211 |
| 2015/0042632 | A1* | 2/2015 | Amino | G09G 3/3696 345/212 |
| 2016/0314754 | A1* | 10/2016 | Lin | G09G 3/3659 |

* cited by examiner

PIXEL CIRCUIT

CROSS-REFERENCE TO RELATED APPLICATIONS

This non-provisional application claims priority under 35 U.S.C. § 119(a) on Patent Application No(s). 104127188 filed in Taiwan, R.O.C. on Aug. 20, 2015, the entire contents of which are hereby incorporated by reference.

TECHNICAL FIELD

The disclosure relates to a pixel circuit, more particularly to a pixel circuit having a high response speed.

BACKGROUND

A conventional liquid crystal display uses a pixel circuit to write and maintain data signals, and modulates the grayscale by the rotation of liquid crystal molecules. A modern liquid crystal display usually requires a high resolution and a high image quality, and the driving frequency for the liquid crystal display has been enhanced from initial 60 Hz to 120 hertz (Hz) and even to more than 240 Hz. In accordance with the driving frequency, the liquid crystal material used in the liquid crystal display needs to have a corresponding response speed. Therefore, such a liquid crystal material having a high response speed has been becoming a point to the liquid crystal display.

However, because of the material's property, the permittivity of such a liquid crystal material having a high response speed is affected by an operation frequency. For example, when the operation frequency is higher than a specific frequency, the permittivity will greatly decrease, resulting in the decreasing of equivalent capacitance value of the liquid crystal. Therefore, the voltage difference between the two ends of the liquid crystal cannot properly be modulated in response to the data signal. Also, the enhancement of the driving frequency causes the greater capacitance frequency effect of the liquid crystal material.

SUMMARY

The disclosure provides a pixel circuit.

In an embodiment, the pixel circuit includes a first capacitor, a second capacitor, a liquid crystal capacitor, a first switch, a second switch, a third switch, a pull-up circuit, and a pull-down circuit. The pull-up circuit includes a first terminal, a second terminal, and a pull-up control terminal. The pull-down circuit includes a third terminal, a fourth terminal, and a pull-down control terminal. The first capacitor has two terminals electrically coupled to a first node and a ground end, respectively. The first switch is electrically coupled to the first node and the first data input end. The liquid crystal capacitor has two terminals electrically coupled to a second node and a third node, respectively. The second switch is electrically coupled to the second node and a second data input end. The pull-up control terminal of the pull-up circuit is electrically coupled to the first node, the first terminal of the pull-up circuit is electrically coupled to a node of a high voltage, and the second terminal of the pull-up circuit is electrically coupled to the second node. The pull-down control terminal of the pull-down circuit is electrically coupled to a fourth node, the third terminal of the pull-down circuit is electrically coupled to the second node, and the fourth terminal of the pull-down circuit is electrically coupled to a ground end. The second capacitor has two terminals electrically coupled to the second node and the fourth node, respectively. The third switch is electrically coupled to the fourth node and the ground end. The first switch selectively and electrically connects the first data input end to the first node in response to a control signal. The second switch selectively and electrically connects the second data input end to the second node in response to the control signal. The third switch selectively and electrically connects the fourth node to the ground end in response to the control signal. The pull-up circuit is enabled or disabled according to a voltage difference between the pull-up control terminal and the second terminal of the pull-up circuit. The pull-down circuit is enabled or disabled according to a voltage difference between the fourth node and the ground end In an embodiment with respect to the aforementioned pixel circuit, the first data input end and the second data input end receive a data signal. When the third node is at a low voltage potential lower than or substantially equal to a voltage potential of the data signal and the data signal and the control signal are high, the first, second and third switches are turned on in response to the control signal and the first and second capacitors and the liquid crystal capacitor are charged by the data signal. A voltage potential of the first node and a voltage potential of the second node both increase to the voltage potential of the data signal, and the fourth node is coupled to the ground end. On the other hand, in another embodiment with respect to the aforementioned pixel circuit, when the third node is at a low voltage potential lower than or substantially equal to the voltage potential of the data signal and the data signal and the control signal change from high to low, the first, second and third switches are turned off in response to the control signal. Herein, an equivalent capacitance value of the liquid crystal capacitor increases, and the voltage potential of the second node and a voltage potential of the fourth node decrease, the pull-up circuit charges the liquid crystal capacitor by the high voltage according to a voltage difference between the first node and the second node. The voltage potential of the first node keeps at the voltage potential of the data signal, the voltage potential of the second node increases to a stable-status voltage that is substantially the voltage potential of the data signal minus an offset voltage, and the voltage potential of the fourth node is substantially equal to a polar inversion of the offset voltage.

Another embodiment of the pixel circuit includes a first capacitor, a second capacitor, a liquid crystal capacitor, a first switch, a second switch, a third switch, a pull-up circuit, and a pull-down circuit. The pull-up circuit includes a pull-up control terminal, a first terminal, and a second terminal. The pull-down circuit includes a pull-down control terminal, a third terminal, and a fourth terminal. The first capacitor has two terminals electrically coupled to a first node and a second node, respectively. The first switch is electrically coupled to the second node and a first data input end. The liquid crystal capacitor has two terminals electrically coupled to a second node and a third node, respectively. The second switch is electrically coupled to the first node and a high voltage. The pull-up control terminal of the pull-up circuit is electrically coupled to the first node, the first terminal of the pull-up circuit is electrically coupled to the node of the high voltage, and the second terminal of the pull-up circuit is electrically coupled to the second node. The pull-down control terminal of the pull-down circuit is electrically coupled to a fourth node, the third terminal of the pull-down circuit is electrically coupled to the second node, and the fourth terminal of the pull-down circuit is electrically coupled to a ground end. The second capacitor has two terminals electrically coupled to the fourth node and the ground end, respectively. The third switch is electrically coupled to the fourth node and a second data input end. The first switch selectively and electrically connects the first data input end to the second node in response to a control signal. The second switch selectively conducts the high voltage to the first node in response to the control signal. The third switch selectively and electrically connects the fourth node to the second data input end in response to the control signal. The pull-up circuit is enabled or disabled according to a voltage difference between the pull-up control terminal and first terminal of the pull-up circuit. The pull-down circuit is enabled or disabled according to a voltage difference between the fourth node and the second node.

In an embodiment with respect to the aforementioned pixel circuit, the first data input end and the second data input end receive a data signal. The first, second and third switches are turned on in response to the control signal when the third node is at a low voltage potential lower than or substantially equal to a voltage potential of the data signal that is high as the control signal is low. Herein, the first capacitor is charged by the data signal and the high voltage, and the second capacitor and the liquid crystal capacitor are charged by the data signal. Also, a voltage potential of the first node increases to the high voltage, and a voltage potential of the second node and a voltage potential of the fourth node increase to the voltage potential of the data signal. Otherwise, in another embodiment with respect to the aforementioned pixel circuit, the first, second and third switches are turned off in response to the control signal when the low voltage potential of the third node is lower than or substantially equal to the voltage potential of the data signal that changes from high to low as the control signal changes from low to high. Herein, an equivalent capacitance value of the liquid crystal capacitor increases, and the voltage potential of the first node and the voltage potential of the second node decrease. The pull-up circuit charges the liquid crystal capacitor by the high voltage according to a voltage difference between the first node and the high voltage. The voltage potential of the first node increases to a first stable-status voltage that is substantially the high voltage minus an offset voltage. The voltage potential of the second node increases to a second stable-status voltage that is substantially the voltage potential of the data signal minus the offset voltage. Also, the voltage potential of the fourth node keeps at the voltage potential of the data signal.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1A:
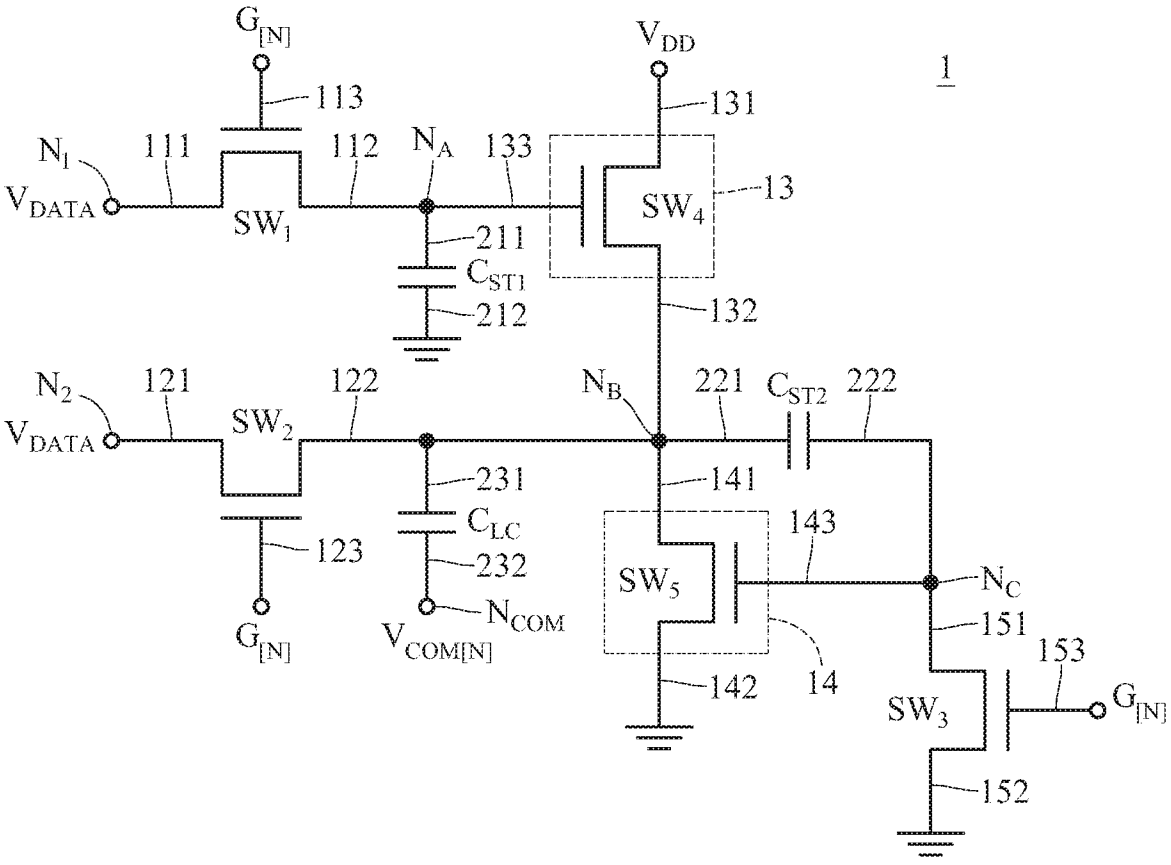
FIG. 1A is a schematic circuit diagram of a pixel circuit in an embodiment.

Please refer to FIG. 1A, which is a schematic circuit diagram of a pixel circuit 1 in an embodiment. The pixel circuit 1 includes a first capacitor $C_{ST1}$, a first switch $SW_1$, a liquid crystal capacitor $C_{LC}$, a second switch $SW_2$, a pull-up circuit 13, a pull-down circuit 14, a second capacitor $C_{ST2}$, and a third switch $SW_3$. The first capacitor $C_{ST1}$ has a first terminal 211 and a second terminal 212, the second capacitor $C_{ST2}$ has a first terminal 221 and a second terminal 222, and the liquid crystal capacitor $C_{LC}$ has a first terminal 231 and a second terminal 232. The first switch $SW_1$ has a first terminal 111, a second terminal 112, and a control terminal 113, the second switch $SW_2$ has a first terminal 121, a second terminal 122, and a control terminal 123, and the third switch $SW_3$ has a first terminal 151, a second terminal 152, and a the control terminal 153. The pull-up circuit 13 includes a first terminal 131, a second terminal 132, and a pull-up control terminal 133, and the pull-down circuit 14 includes a first terminal 141, a second terminal 142, and a pull-down control terminal 143.

The first terminal 211 of the first capacitor $C_{ST1}$ is electrically coupled to a first node $N_A$, and the second terminal 212 of the first capacitor $C_{ST1}$ is electrically coupled to a ground end. The first terminal 111 of the first switch $SW_1$ is electrically coupled to a first data input end $N_1$, and the second terminal 112 of the first switch $SW_1$ is electrically coupled to the first node $N_A$. The first terminal 231 of the liquid crystal capacitor $C_{LC}$ is electrically coupled to a second node $N_B$, and the second terminal 232 of the liquid crystal capacitor $C_{LC}$ is electrically coupled to a third node $N_{COM}$. The first terminal 121 of the second switch $SW_2$ is electrically coupled to a second data input end $N_2$, and the second terminal 122 of the second switch $SW_2$ is electrically coupled to the second node $N_B$. The first terminal 131 of the pull-up circuit 13 is electrically coupled to a node of a high voltage $V_{DD}$, the second terminal 132 of the pull-up circuit 13 is electrically coupled to the second node $N_B$, and the pull-up control terminal 133 of the pull-up circuit 13 is electrically coupled to the first node $N_A$. The first terminal 141 of the pull-down circuit 14 is electrically coupled to the second node $N_B$, the second terminal 142 of the pull-down circuit 14 is electrically coupled to the ground end, and the pull-down control terminal 143 of the pull-down circuit 14 is electrically coupled to a fourth node $N_C$. The first terminal 221 of the second capacitor $C_{ST2}$ is electrically coupled to the second node $N_B$, and the second terminal 222 of the second capacitor $C_{ST2}$ is electrically coupled to the fourth node $N_C$. The first terminal 151 of the third switch $SW_3$ is electrically coupled to the fourth node $N_C$, the second terminal 152 of the third switch $SW_3$ is electrically coupled to the ground end.

The control terminal 113 of the first switch $SW_1$ is electrically coupled to a control signal $G_{[N]}$. That is, the first switch $SW_1$ is controlled by the control signal $G_{[N]}$ to selectively and electrically connects the first data input end $N_1$ to the first node $N_A$. In an embodiment, when the control signal $G_{[N]}$ is at a relatively high voltage potential, the first switch $SW_1$ electrically connects the first data input end $N_1$ to the first node $N_A$. When the control signal $G_{[N]}$ is at a relatively low voltage potential, the first switch $SW_1$ is turned off. A person with ordinary skill in the art of the present invention can, with the teaching of this disclosure, design the voltage potential of the control signal $G_{[N]}$ in response to which the first switch $SW_1$ is turned on. When the first switch $SW_1$ electrically connects the first data input end $N_1$ to the first node $N_A$ in response to the control signal $G_{[N]}$, the voltage potential $V_A$ of the first node $N_A$ will change with a data voltage $V_{DATA}$. The first switch $SW_1$ in FIG. 1A is, for example, but not limited to, an N-type transistor (e.g. a metal-oxide-semiconductor field-effect transistor (MOSFET)). The above switches are, for example, carried out by transistors.

The first capacitor $C_{ST1}$ is selectively charged or discharged according to the data voltage $V_{DATA}$. Specifically, when the first switch $SW_1$ electrically connects the first data input end $N_1$ to the first node $N_A$ in response to the control signal $G_{[N]}$, the first capacitor $C_{ST1}$ is charged by the data voltage $V_{DATA}$ and stores the data voltage $V_{DATA}$ or a similar voltage. When the first switch $SW_1$ is turned off, the first capacitor $C_{ST1}$ is not charged or discharged according to the voltage level of the data voltage $V_{DATA}$. When the first capacitor $C_{ST1}$ has been charged or discharged according to the data voltage $V_{DATA}$ for a sufficient time, the voltage potential of the first terminal 211 of the first capacitor $C_{ST1}$ is the data voltage $V_{DATA}$ or substantially at the data voltage $V_{DATA}$. In other words, the voltage potential of the first node $N_A$ herein is substantially equal to the data voltage $V_{DATA}$.

The control terminal 123 of the second switch $SW_2$ is electrically coupled to the control signal $G_{[N]}$ so that the second switch $SW_2$ selectively and electrically connects the second data input end $N_2$ to the second node $N_B$ in response to the control signal $G_{[N]}$. The detailed operation of the second switch $SW_2$ in response to the control signal $G_{[N]}$ can be deduced by the operation of the first switch $SW_1$ and thus, will not be repeated hereinafter. The second switch $SW_2$ in FIG. 1A is, for example, but not limited to, an N-type transistor.

The liquid crystal capacitor $C_{LC}$ is selectively charged or discharged according to the data voltage $V_{DATA}$. Specifically, when the second switch $SW_2$ electrically connects the second data input end $N_2$ to the second node $N_B$ in response to the control signal $G_{[N]}$, the liquid crystal capacitor $C_{LC}$ is charged or discharged according to the data voltage $V_{DATA}$. When the second switch $SW_2$ is turned off, the voltage level of liquid crystal capacitor $C_{LC}$ is substantially not charged or discharged according to the data voltage $V_{DATA}$. After the liquid crystal capacitor $C_{LC}$ has been charged or discharged according to the data voltage $V_{DATA}$ for a sufficient time, the voltage potential of the first terminal 231 of the liquid crystal capacitor $C_{LC}$ is substantially equal to the data voltage $V_{DATA}$. Herein, the voltage potential of the second node $N_B$ is substantially equal to the data voltage $V_{DATA}$.

In addition, the second terminal 232 of the liquid crystal capacitor $C_{LC}$ receives a modulation voltage $V_{COM[N]}$ from the third node $N_{COM}$, and the liquid crystal capacitor $C_{LC}$ operates under a positive polarity or a negative polarity according to the voltage potential of the modulation voltage $V_{COM[N]}$ and the voltage potential of the data voltage $V_{DATA}$. Particularly, when the voltage potential of the data voltage $V_{DATA}$ is higher than the voltage potential of the modulation voltage $V_{COM[N]}$, the liquid crystal capacitor $C_{LC}$ operates under the positive polarity; otherwise, the liquid crystal capacitor $C_{LC}$ operates under the negative polarity. In other words, in the pixel circuit 1, to control the voltage potential of the modulation voltage $V_{COM[N]}$ can invert the polarity of the liquid crystal capacitor $C_{LC}$ without an additional negative data voltage, so the control complexity of the pixel circuit 1 may decrease.

In practice, the liquid crystal capacitor $C_{LC}$ is carried out by two electrodes and liquid crystal molecules sandwiched in therebetween, and the capacitance value of the liquid crystal capacitor $C_{LC}$ is influenced by the characteristics of the liquid crystal molecules. Because a liquid crystal material is affected by the capacitance frequency effect, the equivalent capacitance value of the liquid crystal capacitor $C_{LC}$ decreases or increases with the operation frequency. In detail, when it is attempted to hold the voltage on the liquid crystal capacitor $C_{LC}$ after the liquid crystal capacitor $C_{LC}$ is charged, the equivalent capacitance value of the liquid crystal capacitor $C_{LC}$ may decrease and the quantity of electric charge stored in the liquid crystal capacitor $C_{LC}$ may not change. Herein, the voltage difference between the two terminals of the liquid crystal capacitor $C_{LC}$ may increase.

The pull-up circuit 13 is enabled or disabled according to the voltage difference between the first node $N_A$ and the second node $N_B$ to selectively charge the liquid crystal capacitor $C_{LC}$ using the high voltage $V_{DD}$. In an embodiment, when the voltage difference between the first node $N_A$ and the second node $N_B$ is greater than a preset threshold, the pull-up circuit 13 is triggered by the voltage difference to charge the liquid crystal capacitor $C_{LC}$ by the high voltage $V_{DD}$. When the voltage difference between the first node $N_A$ and the second node $N_B$ is smaller than the preset threshold, the pull-up circuit 13 stops charging the liquid crystal capacitor $C_{LC}$ by the high voltage $V_{DD}$. The preset threshold is, for example, but not limited to, a threshold voltage of a transistor in the pull-up circuit 13 or a turned-on voltage of a switch module in the pull-up circuit 13. The relevant details will be described later.

The pull-up circuit 13 in FIG. 1A includes a fourth switch $SW_4$ that is, for example, but not limited to, an N-type metal-oxide-semiconductor field-effect transistor (MOSFET). Specifically, the first terminal 131 of the pull-up circuit 13 is a drain electrode of the N-type MOSFET, the second terminal 132 of the pull-up circuit 13 is a source electrode of the N-type MOSFET, and the pull-up control terminal 133 of the pull-up circuit 13 is a gate electrode of the N-type MOSFET. Alternatively, the pull-up circuit 13 is carried out by multiple electronic components. The disclosure has no limitation on the composition of the pull-up circuit 13.

The pull-down circuit 14 is enabled or disabled according to the voltage difference between the fourth node $N_C$ and the ground end to selectively enable a current path from the first terminal 231 of the liquid crystal capacitor $C_{LC}$ to the ground end in order to selectively discharge the liquid crystal capacitor $C_{LC}$ toward the ground end. In an embodiment, when the voltage difference between the fourth node $N_C$ and the ground end is greater than a preset threshold, the pull-down circuit 14 is triggered by the voltage difference to discharge the liquid crystal capacitor $C_{LC}$ to the ground end. When the voltage difference between the fourth node $N_C$ and the ground end is smaller than the preset threshold, the pull-down circuit 14 stops discharging the liquid crystal capacitor $C_{LC}$ to the ground end.

The pull-down circuit 14 in FIG. 1A includes a fifth switch $SW_5$ that is, for example, but not limited to, an N-type MOSFET. Particularly, in an embodiment, the first terminal 141 of the pull-down circuit 14 is a drain electrode of the transistor, the second terminal 142 of the pull-down circuit 14 is a source electrode of the transistor, and the pull-down control terminal 143 of the pull-down circuit 14 is a gate electrode of the transistor. In another embodiment, the pull-down circuit 14 is carried out by multiple electronic components. The disclosure does not have any limitation on the composition of the pull-down circuit 14. Note that the pull-up circuit 13 and the pull-down circuit 14 are used to form a source follower. Specifically, either the pull-up circuit 13 or the pull-down circuit 14 charges or discharge the voltage potential of one terminal of its transistor to a voltage potential substantially equal to the voltage potential of the voltage source (i.e. the high voltage $V_{DD}$ or the ground voltage) at the other terminal of the transistor according to the gate voltage of the transistor. Such a voltage potential, which is substantially equal to the voltage potential of the voltage source, usually has a voltage difference, i.e. a threshold voltage, with the gate voltage of the transistor in the pull-up circuit 13 and the gate voltage of the transistor in the pull-down circuit 14.

The control terminal 153 of the third switch $SW_3$ is electrically coupled to the control signal $G_{[N]}$ so that the third switch $SW_3$ selectively and electrically connects the fourth node $N_C$ to the ground end in response to the control signal $G_{[N]}$. The detailed operation of the third switch $SW_3$ in response to the control signal $G_{[N]}$ can be deduced from the above operation of the first switch $SW_1$ and thus, will not be repeated hereinafter. In this embodiment with respect to FIG. 1A, the third switch $SW_3$ is, for example, but not limited to, an N-type transistor.

The second capacitor $C_{ST2}$ is selectively charged or discharged according to the data voltage $V_{DATA}$. The charging and discharging of the second capacitor $C_{ST2}$ can be deduced in view of the charging and discharging of the first capacitor $C_{ST1}$ and the liquid crystal capacitor $C_{LC}$ and the description with respect to FIG. 1A and thus, will not be repeated hereinafter.

Figure 1B:
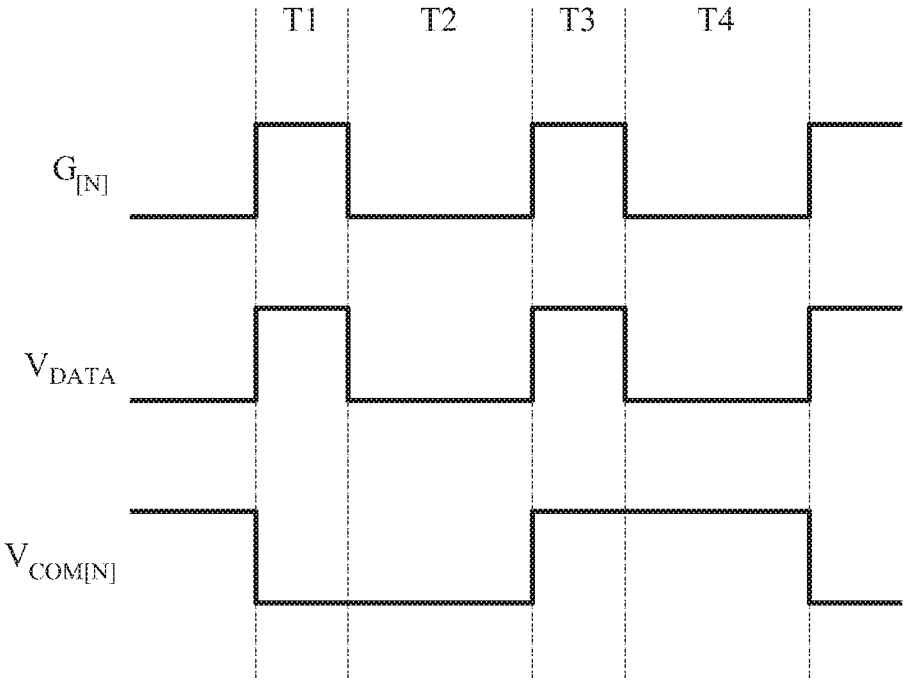
FIG. 1B is a time sequential diagram of the pixel circuit in FIG. 1A in an embodiment.

In order to illustrate the operation of the pixel circuit, please refer to FIG. 1A and FIG. 1B. FIG. 1B is a time sequential diagram of the pixel circuit in FIG. 1A in an embodiment. As shown in FIG. 1B, the pixel circuit 1 operates at a data voltage input stage during a first time period T1 and a third time period T3. In this data voltage input stage, the control signal $G_{[N]}$ is at a high voltage potential. The pixel circuit 1 operates at a data voltage maintaining stage during a second time period T2 and a fourth time period T4. In this data voltage maintaining stage, the control signal $G_{[N]}$ is at a low voltage potential. The details about the data voltage input stage and the data voltage maintaining stage will be described later.

The modulation voltage $V_{COM[N]}$ is at a low voltage potential during the first time period T1 and the second time period T2, and the modulation voltage $V_{COM[N]}$ is at a high voltage potential during the third time period T3 and the fourth time period T4. The modulation voltage $V_{COM[N]}$ at a low voltage potential is lower than or substantially equal to the data voltage $V_{DATA}$, and the modulation voltage $V_{COM[N]}$ at a high voltage potential is higher than or substantially equal to the data voltage $V_{DATA}$. Therefore, the liquid crystal operates in a positive polarity during the first time period T1 and the second time period T2. During the third time period T3 and the fourth time period T4, the liquid crystal operates in a negative polarity.

Firstly, the operation of the pixel circuit 1, whose liquid crystal operates in the positive polarity, is described below.

During the first time period T1, the pixel circuit 1 operates in the data voltage input stage in which the liquid crystal operates in the positive polarity. The control signal $G_{[n]}$ is at a high voltage potential, and the modulation voltage $V_{COM[N]}$ is at a low voltage potential. Therefore, the first switch $SW_1$, the second switch $SW_2$ and the third switch $SW_3$ are turned on, but the fourth switch $SW_4$ and the fifth switch $SW_5$ are turned off. The first node $N_A$ and the second node $N_B$ are electrically connected to the first data input end $N_1$ and the second data input end $N_2$, respectively, and the fourth node $N_C$ is electrically connected to the ground end. Therefore, the first capacitor $C_{ST1}$, the second capacitor $C_{ST2}$ and the liquid crystal capacitor $C_{LC}$ are charged according to the data voltage $V_{DATA}$.

In the data voltage input stage, the voltage potential $V_A$ of the first node $N_A$ and the voltage potential $V_B$ of the second node $N_B$ are charged to the data voltage $V_{DATA}$. Also, the fourth node $N_C$ is electrically coupled to the ground end so the voltage potential $V_C$ of the fourth node $N_C$ is zero. The voltage difference between the two ends of the second capacitor $C_{ST2}$ is substantially equal to the difference between the voltage potential $V_B$ and the voltage potential $V_C$, so the voltage difference between the two ends of the second capacitor $C_{ST2}$ is substantially equal to the data voltage $V_{DATA}$.

During the second time period T2, the pixel circuit 1 changes from the data voltage input stage to the data voltage maintaining stage, so the liquid crystal operates in the positive polarity as the same as the pixel circuit 1 operating during the first time period T1. The data voltage $V_{DATA}$ and the control signal $G_{[n]}$ change from a high voltage potential to a low voltage potential, and the modulation voltage $V_{COM[N]}$ maintains at a low voltage potential. In view of the structure of the pixel circuit 1, the data voltage $V_{DATA}$ is at a high voltage potential or a low voltage potential during the fourth time period T4. The foregoing description is merely exemplary, and the disclosure is not restricted to the above embodiments.

Herein, the first switch $SW_1$, the second switch $SW_2$ and the third switch $SW_3$ are turned off. The voltage potential $V_A$ of the first node $N_A$ is substantially equal to the data voltage $V_{DATA}$. However, because of the capacitance frequency effect, the equivalent capacitance value of the liquid crystal capacitor $C_{LC}$ increases but the voltage difference between the two terminals of the liquid crystal capacitor $C_{LC}$ decreases. Also, when the modulation voltage $V_{COM[N]}$ is substantially constant and is smaller than or substantially equal to the data voltage $V_{DATA}$ during the first time period T1 and the second time period T2, the voltage potential $V_B$ of the second node $N_B$ decreases because of the capacitance coupling effect.

Then, the pixel circuit 1 lacks any current path for the discharge of the second capacitor $C_{ST2}$, so the voltage difference between the two ends of the second capacitor $C_{ST2}$ is still substantially equal to the data voltage $V_{DATA}$. However, when the third switch $SW_3$ is turned off and the second terminal 222 of the second capacitor $C_{ST2}$ is floating, the voltage potential of the second terminal 222 changes with the voltage potential of the first terminal 221 because of the capacitance coupling effect. Therefore, the voltage potential $V_C$ of the fourth node $N_C$ decreases with the voltage potential $V_B$, resulting in the continuously turned-off of the fifth switch $SW_5$.

On the other hand, because the voltage potential $V_B$ of the second node $N_B$ decreases, the voltage difference between the first node $N_A$ and the second node $N_B$ is larger than the threshold voltage $V_{TH4}$ of the fourth switch $SW_4$, and then the fourth switch $SW_4$ is turned on. Herein, the pull-up circuit 13 charges the liquid crystal capacitor $C_{LC}$ according to the high voltage $V_{DD}$, and the voltage potential $V_B$ of the second node $N_B$ is charged to a stable-status voltage that is substantially the data voltage $V_{DATA}$ minus an offset voltage. In this embodiment, the offset voltage herein is the threshold voltage $V_{TH4}$. While the voltage potential $V_B$ is charged to the stable-status voltage, the voltage potential $V_C$ of the fourth node $N_C$ also increases to a polar inversion of the offset voltage, i.e. a polar inversion of the threshold voltage $V_{TH4}$, due to the capacitance coupling effect.

Therefore, when the pixel circuit 1 in the positive polarity operation changes from the data voltage input stage to the data voltage maintaining stage, the voltage difference between the two ends of the liquid crystal capacitor $C_{LC}$ decreases due to the capacitance frequency effect, whereby the fourth switch $SW_4$ in the pull-up circuit 13 is turned on. Herein, the pull-up circuit 13 charges the liquid crystal capacitor $C_{LC}$ according to the high voltage $V_{DD}$. Also, the voltage potential of the first terminal 231 of the liquid crystal capacitor $C_{LC}$ is then pulled up to a voltage potential that is close to the data voltage $V_{DATA}$, so as to compensate the loss of the voltage difference between the two ends of the liquid crystal caused by the capacitance frequency effect. Therefore, the voltage difference between the two ends of the liquid crystal may be maintained at a desired voltage potential.

Subsequently, the operation of the pixel circuit 1, in which the liquid crystal operates in the negative polarity, is described below.

During the third time period T3, the pixel circuit 1 is in the data voltage input stage, and the liquid crystal operates in the negative polarity. The control signal $G_{[n]}$, the data voltage $V_{DATA}$ and the modulation voltage $V_{COM[N]}$ each is at a high voltage potential. Herein, the first switch $SW_1$, the second switch $SW_2$ and the third switch $SW_3$ are turned on, but the fourth switch $SW_4$ and the fifth switch $SW_5$ are turned off. The first node $N_A$ and the second node $N_B$ are electrically connected to the first data input end $N_1$ and the second data input end $N_2$, respectively, and the fourth node $N_C$ is electrically connected to the ground end. Therefore, the first capacitor $C_{ST1}$, the second capacitor $C_{ST2}$ and the liquid crystal capacitor $C_{LC}$ are charged with the data voltage $V_{DATA}$.

In the data voltage input stage, the voltage potential $V_A$ of the first node $N_A$ and the voltage potential $V_B$ of the second node $N_B$ are charged to the data voltage $V_{DATA}$, and the voltage potential $V_C$ of the fourth node $N_C$ electrically coupled to the ground end is zero. Also, the voltage difference between the two ends of the second capacitor $C_{ST2}$ is the difference between the voltage potential $V_B$ and the voltage potential $V_C$, so the voltage difference between the two ends of the second capacitor $C_{ST2}$ is substantially equal to the data voltage $V_{DATA}$.

During the fourth time period T4, the pixel circuit 1 switches from the data voltage input stage to the data voltage maintaining stage, and the liquid crystal operates in the negative polarity. The data voltage $V_{DATA}$ and the control signal $G_{[n]}$ change from a high voltage potential to a low voltage potential, and the modulation voltage $V_{COM[N]}$ maintains at a high voltage potential. Note that, in view of the circuit structure of the pixel circuit 1, the data voltage $V_{DATA}$ is at a high voltage potential or at a low voltage potential during the fourth time period T4. The above description concerning to the data voltage $V_{DATA}$ is merely exemplary rather than is used to limit the scope of the disclosure.

Accordingly, the first switch $SW_1$, the second switch $SW_2$ and the third switch $SW_3$ are turned off, and the voltage potential $V_A$ of the first node $N_A$ substantially maintains at the voltage potential of the data voltage $V_{DATA}$. However, due to the capacitance frequency effect, the equivalent capacitance value of the liquid crystal capacitor $C_{LC}$ may increase, resulting in the decrease of the voltage difference between the two ends of the liquid crystal capacitor $C_{LC}$. Moreover, since the modulation voltage $V_{COM[N]}$ is constant and is larger than or substantially equal to the data voltage $V_{DATA}$ during the third time period T3 and the fourth time period T4, the voltage potential $V_B$ of the second node $N_B$ increases due to the capacitance coupling effect.

Furthermore, the pixel circuit 1 herein does not provide the second capacitor $C_{ST2}$ with any current path for discharging, so the voltage difference between the two ends of the second capacitor $C_{ST2}$ still maintains at about the voltage potential of the data voltage $V_{DATA}$. Also, since the third switch $SW_3$ is turned off and the second terminal 222 of the second capacitor $C_{ST2}$ is floating, the voltage potential of the second terminal 222 is also floating with the voltage potential of the first terminal 221 due to the capacitance coupling effect. Therefore, the voltage potential $V_C$ of the fourth node $N_C$ increases with the voltage potential $V_B$.

Then, because the increasing voltage potential $V_C$ of the fourth node $N_C$ causes that the voltage difference between the fourth node $N_C$ and the ground end is higher than the threshold voltage $V_{TH5}$ of the fifth switch $SW_5$, the fifth switch $SW_5$ is turned on, and the pull-down circuit 14 controls the liquid crystal capacitor $C_{LC}$ to discharge to the ground end in response. Therefore, the voltage potential $V_B$ of the second node $N_B$ is discharged to another stable-status voltage that is substantially the data voltage $V_{DATA}$ plus an offset voltage which is substantially the threshold voltage $V_{TH5}$ in this embodiment. While the voltage potential $V_B$ is charged to about the stable-status voltage, the voltage potential $V_C$ of the fourth node $N_C$ substantially drops to a positive offset voltage, i.e. the positive threshold voltage $V_{TH5}$, due to the capacitance coupling effect.

Accordingly, when the pixel circuit 1 under the negative polarity operation changes from the data voltage input stage to the data voltage maintaining stage, although the voltage difference between the two ends of the liquid crystal decreases because of the capacitance frequency effect of the liquid crystal, the fifth switch $SW_5$ in the pull-down circuit 14 is turned on in response to the decrease of the voltage difference between the two ends of the liquid crystal, and then the liquid crystal capacitor $C_{LC}$ charges the ground end. Therefore, the voltage potential of the first terminal 231 of the liquid crystal capacitor $C_{LC}$ drops to a voltage potential approaching the data voltage $V_{DATA}$, and the increment of the voltage difference between the two ends of the liquid crystal caused by the capacitance frequency effect is compensated to maintain the voltage difference between the two ends of the liquid crystal to be at a desired voltage potential.

Moreover, as described with respect to FIG. 1A and FIG. 1B, the fifth switch $SW_5$ in the pull-down circuit 14 is turned off during the second time period T2. The fifth switch $SW_5$ is, for example, but not limited to, an N-type MOSFET. The voltage potential of the fourth node $N_C$ is lower than the voltage potential of the ground end so that the source voltage of the fifth switch $SW_5$ is higher than the gate voltage of the fifth switch $SW_5$, resulting in that the fifth switch $SW_5$ works in a reverse bias. Likewise, the fourth switch $SW_4$ in the pull-up circuit 13 is turned off during the fourth time period T4 and works in the reverse bias. As shown in FIG. 2B, the second time period T2 and the fourth time period T4 are longer than the first time period T1 and the third time period T3, so it indicates that the fourth switch $SW_4$ and the fifth switch $SW_5$ each will work in the reverse bias for a long time. In this way, the pixel circuit 1 may slow down the aging of components in addition to overcoming the influence of the capacitance frequency effect.

Figure 2:
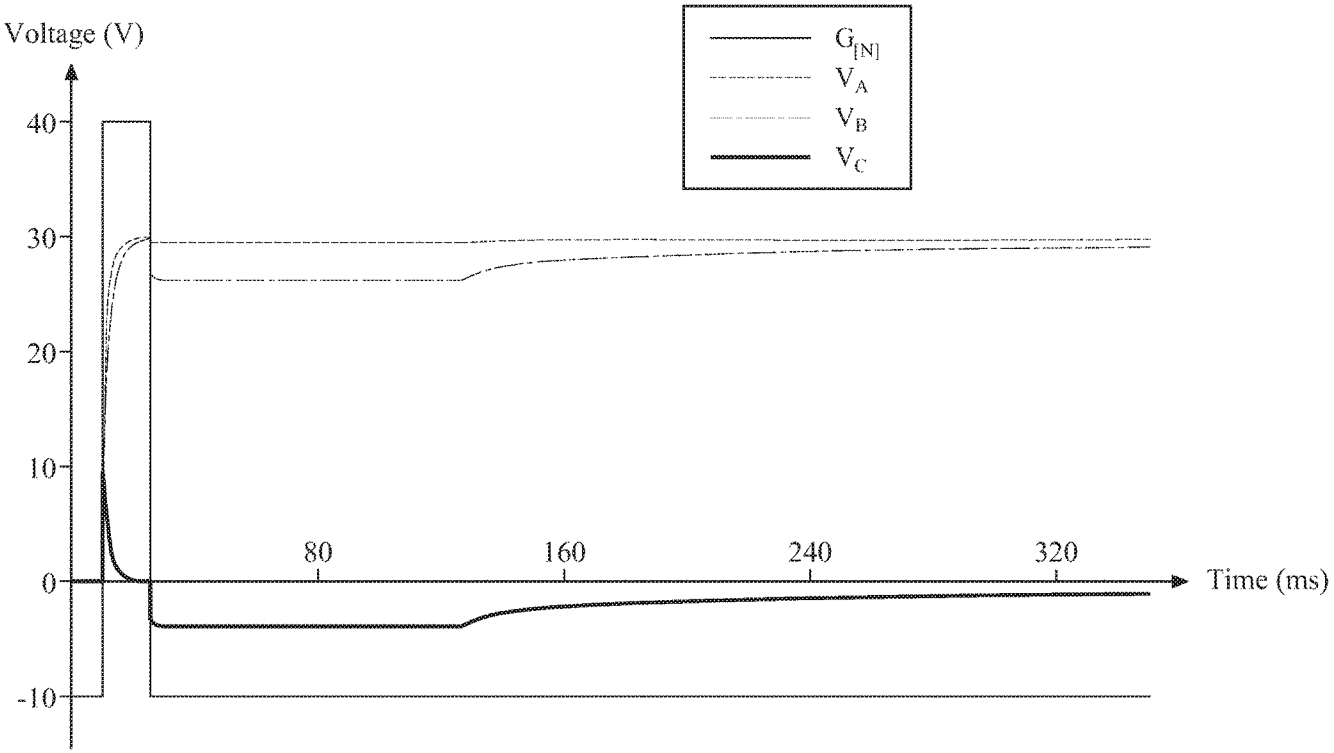
FIG. 2 is a schematic diagram of the simulation of voltage variation of each node in the pixel circuit in FIG. 1A during the positive cycle in an embodiment.

Next, please refer to FIG. 2, which is a schematic diagram of the simulation of voltage variation of each node in the pixel circuit in FIG. 1A during the positive polarity operation in an embodiment. FIG. 2 is obtained by simulating an amorphous silicon (a-Si) equivalent model. In the figure, the horizontal axis represents time in the unit of micro second (p), and the vertical axis represents voltage in the unit of volt (V). The figure presents the voltage potential of the control signal $G_{[N]}$, the voltage potential $V_A$ of the first node $N_A$, the voltage potential of the second node $N_B$, and the voltage potential $V_C$ of the fourth node $N_C$.

In this embodiment with respect to FIG. 2, the data voltage $V_{DATA}$ is 30 V, and the modulation voltage $V_{COM[N]}$ is 0 V. When the control signal $G_{[N]}$ is at a high voltage potential, the voltage potential $V_A$ of the first node $N_A$ and the voltage potential $V_B$ of the second node $N_B$ are charged to about 30 V, and the voltage potential $V_C$ of the fourth node $N_C$ drops to about zero. All the details can be referred to the previous description and thus, will not be repeated hereinafter.

As shown in FIG. 2, when the control signal $G_{[N]}$ changes from a high voltage potential to a low voltage potential, the voltage potential $V_A$ of the first node $N_A$ maintains at about 30 V. In this embodiment, the voltage potential $V_A$ is about 29.72 V. Due to the capacitance frequency effect, the voltage potential $V_B$ of the second node $N_B$ drops an error voltage. Meanwhile, the voltage potential $V_C$ of the fourth node $N_C$ also drops an error voltage due to the capacitance coupling effect. The decrement of the voltage potential $V_C$ is substantially equal to the decrement of the voltage potential $V_B$.

While the voltage potential $V_B$ of the second node $N_B$ decreases, the pull-up circuit 13 is triggered to pull the voltage potential $V_B$ of the second node $N_B$ up to a voltage potential, e.g. about 30 V, approaching the data voltage $V_{DATA}$ according to the high voltage $V_{DD}$. Particularly, the voltage potential $V_B$ is pulled up to a stable-status voltage that is substantially the data voltage $V_{DATA}$ minus a threshold voltage $V_{TH4}$. In this embodiment, the voltage potential $V_B$ is pulled up to about 29.03 V. Because of the capacitance coupling effect caused by the second capacitor $C_{ST2}$, the voltage potential $V_C$ is pulled up to a voltage potential approaching the ground voltage. In an embodiment with respect to FIG. 2, the voltage potential $V_C$ is pulled up to about −1.12 V. Note that the foregoing voltage potentials are based on the components' properties so they are merely exemplary rather than are used to limit the disclosure.

Figure 3A:
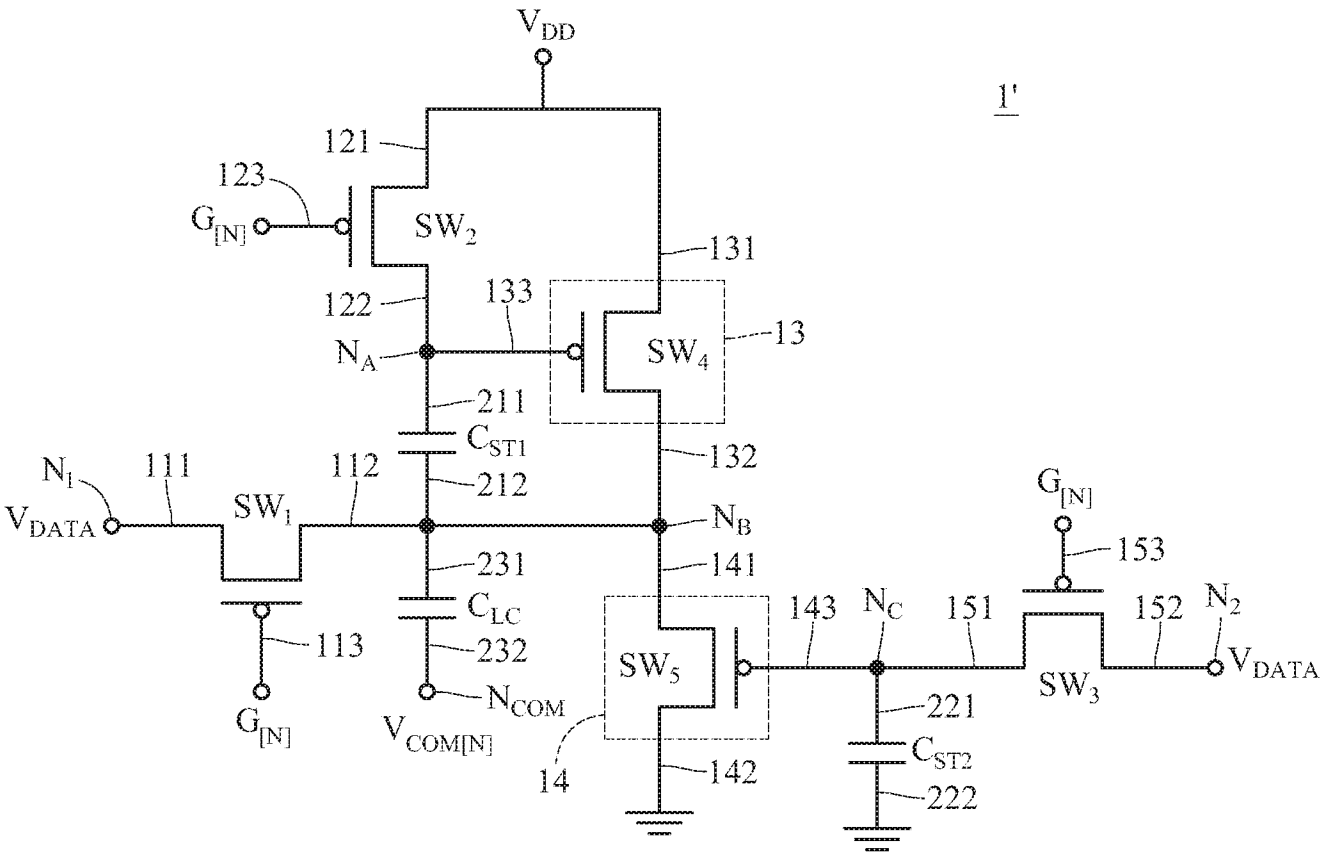
FIG. 3A is a schematic circuit diagram of a pixel circuit in another embodiment.

Please refer to FIG. 3A. FIG. 3A is a schematic circuit diagram of a pixel circuit 1' in another embodiment. The pixel circuit 1' includes a first capacitor $C_{ST1}$, a first switch $SW_1$, a liquid crystal capacitor $C_{LC}$, a second switch $SW_2$, a pull-up circuit 13, a pull-down circuit 14, a second capacitor $C_{ST2}$, and a third switch $SW_3$. The first capacitor $C_{ST1}$ has a first terminal 211 and a second terminal 212, the second capacitor $C_{ST2}$ has a first terminal 221 and a second terminal 222, and the liquid crystal capacitor $C_{LC}$ has a first terminal 431 and a second terminal 432. The first switch $SW_1$ has a first terminal 111, a second terminal 112, and a control terminal 113; the second switch $SW_2$ has a first terminal 121, a second terminal 122, and a control terminal 123; and the third switch $SW_3$ has a first terminal 151, a second terminal 152, and a control terminal 153. The pull-up circuit 13 includes a first terminal 131, a second terminal 132, and a pull-up control terminal 133; and the pull-down circuit 14 includes a first terminal 141, a second terminal 142, and a pull-down control terminal 143.

The first terminal 211 of the first capacitor $C_{ST1}$ is electrically coupled to the first node $N_A$, and the second terminal 212 is electrically coupled to the second node $N_B$. The first terminal 111 of the first switch $SW_1$ is electrically coupled to the first data input end $N_1$, and the second terminal 112 is electrically coupled to the second node $N_B$. The first terminal 231 of the liquid crystal capacitor $C_{LC}$ is electrically coupled to the second node $N_B$, and the second terminal 232 is electrically coupled to the third node $N_{COM}$. The first terminal 121 of the second switch $SW_2$ is electrically coupled to a node of a high voltage $V_{DD}$, and the second terminal 122 is electrically coupled to the first node $N_A$. The first terminal 131 of the pull-up circuit 13 is electrically coupled to the node of the high voltage $V_{DD}$, the second terminal 132 is electrically coupled to the second node $N_B$, and the pull-up control terminal 133 is electrically coupled to the first node $N_A$. The first terminal 141 of the pull-down circuit 14 is electrically coupled to the second node $N_B$, the second terminal 142 is electrically coupled to the ground end, and the pull-down control terminal 143 is electrically coupled to the fourth node $N_C$. The first terminal 221 of the second capacitor $C_{ST2}$ is electrically coupled to the fourth node $N_C$, and the second terminal 222 is electrically coupled to the ground end. The first terminal 151 of the third switch $SW_3$ is electrically coupled to the fourth node $N_C$, and the second terminal 152 is electrically coupled to the second data input end $N_2$.

The pull-up circuit 13 is enabled or disabled according to the voltage difference between the pull-up control terminal 133 and the first terminal 131. The pull-down circuit 14 is enabled or disabled according to the voltage difference between the fourth node $N_C$ and the second node $N_B$. In an embodiment with respect to FIG. 3A, the pull-up circuit 13 and the pull-down circuit 14 include a fourth switch $SW_4$ and a fifth switch $SW_5$, respectively. The first switch $SW_1$, the second switch $SW_2$, the third switch $SW_3$, the fourth switch $SW_4$ and the fifth switch $SW_5$ are, for example, but not limited to, P-type MOSFETs. A person skilled in the art may be able to deduce the detailed description about the components in FIG. 3A in view of the relevant description with respect to FIG. 1A, and thus, it will not be repeated hereinafter. The pull-up circuit 13 and the pull-down circuit 14 function as source followers. Specifically, the pull-up circuit 13 and the pull-down circuit 14 can use a voltage source (the high voltage $V_{DD}$ or a ground voltage) at their one terminal to charge or discharge the other terminal to a voltage potential substantially equal to the voltage potential of the voltage source in response to their transistor's gate voltages. In general, such a voltage potential has a voltage difference, i.e. a threshold voltage, with the gate voltages of the transistors in the pull-up circuit 13 and the pull-down circuit 14, respectively.

Figure 3B:
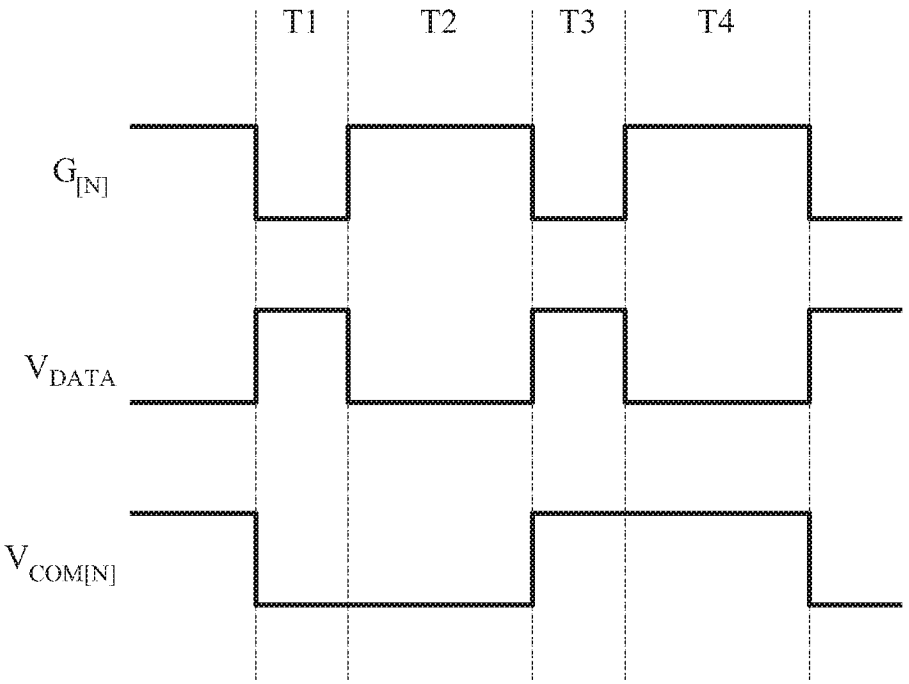
FIG. 3B is a time sequential diagram of the pixel circuit in FIG. 3A in an embodiment.

Please refer to FIG. 3A and FIG. 3B to illustrate the operation of a pixel circuit. FIG. 3B is a time sequential diagram of the pixel circuit 1' in FIG. 3A in an embodiment. The pixel circuit 1' is at the data voltage input stage during the first time period T1 and the third time period T3, and the control signal $G_{[N]}$ herein is at a low voltage potential. The pixel circuit 1' is at the data voltage maintaining stage during the second time period T2 and the fourth time period T4, and the control signal $G_{[N]}$ herein is at a high voltage potential.

The modulation voltage $V_{COM[N]}$ is at a low voltage potential during the first time period T1 and the second time period T2 but is at a high voltage potential during the third time period T3 and the fourth time period T4. The low voltage potential of the modulation voltage $V_{COM[N]}$ is lower than or substantially equal to the voltage potential of the data voltage $V_{DATA}$, and the high voltage potential of the modulation voltage $V_{COM[N]}$ is higher than or substantially equal to the voltage potential of the data voltage $V_{DATA}$. Therefore, the liquid crystal operates under the positive polarity during the first time period T1 and the second time period T2 and operates under the negative polarity during the third time period T3 and the fourth time period T4.

First, the operation of the pixel circuit 1', in which the liquid crystal operates at the positive polarity, is described below.

During the first time period T1, the pixel circuit 1' is at the data voltage input stage, the liquid crystal is at the positive polarity, the control signal $G_{[n]}$ and the modulation voltage $V_{COM[N]}$ each is at a low voltage potential, and the data voltage $V_{DATA}$ is at a high voltage potential. Herein, the first switch $SW_1$, the second switch $SW_2$ and the third switch $SW_3$ are turned on, and the fourth switch $SW_4$ and the fifth switch $SW_5$ are turned off. The first node $N_A$ is electrically connected to the node of the high voltage $V_{DD}$, the second node $N_B$ is electrically connected to the first data input end $N_1$, and the fourth node $N_C$ is electrically connected to the second data input end $N_2$. Therefore, the first capacitor $C_{ST1}$, the second capacitor $C_{ST2}$ and the liquid crystal capacitor $C_{LC}$ are charged by the data voltage $V_{DATA}$.

At the data voltage input stage, the voltage potential $V_A$ of the first node $N_A$ is charged to about the voltage potential of the high voltage $V_{DD}$, and the voltage potential $V_B$ of the second node $N_B$ and the voltage potential $V_C$ of the fourth node $N_C$ are charged to about the voltage potential of the data voltage $V_{DATA}$. The voltage difference between the two ends of the first capacitor $C_{ST1}$ is the difference between the voltage potential $V_A$ and the voltage potential $V_B$ and is substantially the high voltage $V_{DD}$ minus the data voltage $V_{DATA}$. The voltage difference between the two ends of the second capacitor $C_{ST2}$ is the difference between the voltage potential $V_C$ and the voltage potential of the ground end and is substantially equal to the data voltage $V_{DATA}$. The voltage difference between the two ends of the liquid crystal capacitor $C_{LC}$ is the difference between the voltage potential $V_B$ and the modulation voltage $V_{COM[N]}$ and is substantially the data voltage $V_{DATA}$ minus the modulation voltage $V_{COM[N]}$.

During the second time period T2, the pixel circuit 1' changes from the data voltage input stage to the data voltage maintaining stage, the liquid crystal is still at the positive polarity, the control signal $G_{[n]}$ changes from a low voltage potential to a high voltage potential, the data voltage $V_{DATA}$ changes from a high voltage potential to a low voltage potential, and the modulation voltage $V_{COM[N]}$ is still at a low voltage potential. Note that because of the circuit structure of the pixel circuit 1', the data voltage $V_{DATA}$ may be at a high or low voltage potential during the second time period T2. The above description is merely exemplary, and the disclosure is not restricted to the above description.

Herein, the first switch $SW_1$, the second switch $SW_2$ and the third switch $SW_3$ are turned off, and the first capacitor $C_{ST1}$, the second capacitor $C_{ST2}$ and the liquid crystal capacitor $C_{LC}$ stop being charged by the data voltage $V_{DATA}$. Due to the capacitance frequency effect, the equivalent capacitance value of the liquid crystal capacitor $C_{LC}$ increases, so the voltage difference between the two ends of the liquid crystal capacitor $C_{LC}$ decreases. Moreover, the modulation voltage $V_{COM[N]}$ is constant and is lower than or is substantially equal to the voltage potential of the data voltage $V_{DATA}$ during the first time period T1 and the second time period T2. Therefore, because of the capacitance coupling effect caused by the liquid crystal capacitor $C_{LC}$, the voltage potential $V_B$ of the second node $N_B$ slightly decreases from the voltage potential of the data voltage $V_{DATA}$.

Herein, the pixel circuit 1' does not provide the first capacitor $C_{ST1}$ with any current path for discharging, so the voltage difference between the two ends of the first capacitor $C_{ST1}$ is still substantially equal to the voltage potential of the data voltage $V_{DATA}$. However, the capacitance coupling effect causes that the voltage potential of the first terminal 211 of the first capacitor $C_{ST1}$ is floating with the voltage potential of the second terminal 212. Therefore, the voltage potential $V_A$ of the first node $N_A$ decreases with the voltage potential $V_B$.

Accordingly, the difference between the voltage potential $V_A$ and the high voltage $V_{DD}$ is lower than the threshold voltage $V_{TH4}$ of the fourth switch $SW_4$, and the fourth switch $SW_4$ is then turned on. The pull-up circuit 13 charges the liquid crystal capacitor $C_{LC}$ with the high voltage $V_{DD}$, so the voltage potential $V_B$ of the second node $N_B$ is charged to a stable-status voltage. The voltage potential $V_B$ herein is substantially the data voltage $V_{DATA}$ minus an offset voltage that is the absolute value of the threshold voltage $V_{TH4}$ in this embodiment. While the voltage potential $V_B$ is charged to the stable-status voltage, the voltage potential $V_A$ of the first node $N_A$ also increases to a voltage, which is substantially the high voltage $V_{DD}$ minus the offset voltage (i.e. the high voltage $V_{DD}$ minus the absolute value of the threshold voltage $V_{TH4}$), due to the capacitance coupling effect.

Accordingly, when the pixel circuit 1' under the positive polarity operation changes from the data voltage input stage to the data voltage maintaining stage, although the voltage difference between the two ends of the liquid crystal capacitor $C_{LC}$ decreases because of the capacitance frequency effect of the liquid crystal, the fourth switch $SW_4$ in the pull-up circuit 13 is turned on in response to the voltage difference between the two ends of the liquid crystal. Herein, the pull-up circuit 13 charges the liquid crystal capacitor $C_{LC}$ according to the high voltage $V_{DD}$. Therefore, the voltage potential of the first terminal 411 of the liquid crystal capacitor $C_{LC}$ is pulled up to about the data voltage $V_{DATA}$, so as to compensate the loss of the voltage difference between the two ends of the liquid crystal caused by the capacitance frequency effect. In this way, the voltage difference between the two ends of the liquid crystal may be maintained at a desired voltage potential.

Then, the operation of the pixel circuit 1', in which the liquid crystal operates under the negative polarity, is described below.

During the third time period T3, the pixel circuit 1' is at the data voltage input stage, the liquid crystal operates in the negative polarity, the control signal $G_{[n]}$ is at a low voltage potential while the data voltage $V_{DATA}$ and the modulation voltage $V_{COM[N]}$ each is at a high voltage potential. Herein, the first switch $SW_1$, the second switch $SW_2$ and the third switch $SW_3$ are turned on, but the fourth switch $SW_4$ and the fifth switch $SW_5$ are turned off. Also, the second node $N_B$ and the fourth node $N_C$ are electrically connected to the first data input end $N_1$ and the second data input end $N_2$, respectively, and the first node $N_A$ is electrically connected to the node of the high voltage $V_{DD}$. Therefore, the first capacitor $C_{ST1}$, the second capacitor $C_{ST2}$ and the liquid crystal capacitor $C_{LC}$ are charged with the data voltage $V_{DATA}$.

At the data voltage input stage, the voltage potential $V_B$ of the second node $N_B$ and the voltage potential $V_C$ of the fourth node $N_C$ are charged to about the voltage potential of the data voltage $V_{DATA}$ as the voltage potential $V_A$ of the first node $N_A$ is charged to about the voltage potential of the high voltage $V_{DD}$. The voltage difference between the two ends of the first capacitor $C_{ST1}$ is substantially the difference between the voltage potential $V_A$ and the voltage potential $V_B$, and is substantially the high voltage $V_{DD}$ minus the data voltage $V_{DATA}$. The voltage difference between the two ends of the second capacitor $C_{ST2}$ is substantially the difference between the voltage potential $V_C$ and the voltage potential of the ground end. Therefore, the voltage difference between the two ends of the second capacitor $C_{ST2}$ is substantially equal to the data voltage $V_{DATA}$, the voltage difference between the two ends of the liquid crystal capacitor $C_{LC}$ is substantially equal to the difference between the voltage potential $V_B$ and the modulation voltage $V_{COM[N]}$, and is substantially the data voltage $V_{DATA}$ minus the modulation voltage $V_{COM[N]}$.

During the fourth time period T4, the pixel circuit 1' switches from the data voltage input stage to the data voltage maintaining stage, the liquid crystal operates under the negative polarity, the control signal $G_{[n]}$ changes from a low voltage potential to a high voltage potential, the data voltage $V_{DATA}$ changes from a high voltage potential to a low voltage potential, and the modulation voltage $V_{COM[N]}$ keeps at a high voltage potential. Note that based on the circuit structure of the pixel circuit 1', the data voltage $V_{DATA}$ is at a high or low voltage potential during the fourth time period T4. The above description is merely exemplary, and the disclosure is not restricted to the above description.

In this period, the first switch $SW_1$, the second switch $SW_2$ and the third switch $SW_3$ are turned off, and the first capacitor $C_{ST1}$, the second capacitor $C_{ST2}$ and the liquid crystal capacitor $C_{LC}$ are not charged with the data voltage $V_{DATA}$. Due to the capacitance frequency effect, the equivalent capacitance value of the liquid crystal capacitor $C_{LC}$ increases, so the voltage difference between the two ends of the liquid crystal capacitor $C_{LC}$ decreases. Since the modulation voltage $V_{COM[N]}$ is constant and is higher than or substantially equal to the data voltage $V_{DATA}$ during the third time period T3 and the fourth time period T4, the voltage potential $V_B$ of the second node $N_B$ increases due to the capacitance coupling effect.

Therefore, the pixel circuit 1' does not provide the first capacitor $C_{ST1}$ with any current path for discharging so that the voltage difference between the two ends of the first capacitor $C_{ST1}$ is still substantially the high voltage $V_{DD}$ minus the data voltage $V_{DATA}$. Moreover, because the second switch $SW_2$ herein is turned off and the first terminal 211 of the first capacitor $C_{ST1}$ is floating, the voltage potential of the first terminal 211 is changing in response to the voltage potential of the second terminal 212 due to the capacitance coupling effect. Therefore, the voltage potential $V_A$ of the first node $N_A$ increases with the voltage potential $V_B$, and the fourth switch $SW_4$ is then turned off.

On the other hand, when the voltage potential $V_B$ increases, the voltage difference between the fourth node $N_C$ and the second node $N_B$ is lower than the threshold voltage $V_{TH5}$ of the fifth switch $SW_5$, so that the fifth switch $SW_5$ is turned on. Therefore, the pull-down circuit 14 controls the liquid crystal capacitor $C_{LC}$ to discharge its stored energy to the ground end through the fifth switch $SW_5$, and the voltage potential $V_B$ of the second node $N_B$ is discharged to another stable-status voltage that is substantially the data voltage $V_{DATA}$ plus an offset voltage. In this embodiment, the offset voltage herein is an absolute value of the threshold voltage $V_{TH5}$. When the voltage potential $V_B$ is charged to a stable-status voltage, the voltage potential $V_A$ of the first node $N_A$ also increases to a voltage, which is substantially the high voltage $V_{DD}$ plus the offset voltage and is substantially the high voltage $V_{DD}$ plus the absolute value of the threshold voltage $V_{TH5}$, due to the capacitance coupling effect.

Accordingly, when the pixel circuit 1' is under the negative polarity operation and switches from the data voltage input stage to the data voltage maintaining stage, although the voltage difference between the two ends of the liquid crystal decreases because of the capacitance frequency effect of the liquid crystal, the fifth switch $SW_5$ in the pull-down circuit 14 is turned on in response to the voltage difference between the two ends of the liquid crystal. Therefore, the liquid crystal capacitor $C_{LC}$ discharges to the ground end, and then the voltage potential of the first terminal 231 of the liquid crystal capacitor $C_{LC}$ drops to a voltage potential approaching the data voltage $V_{DATA}$, so as to compensate the increment of the voltage difference between the two ends of the liquid crystal caused by the capacitance frequency effect. Then, the voltage difference between the two ends of the liquid crystal may be maintained at a desired voltage potential.

In addition, the fifth switch $SW_5$ in the pull-down circuit 14 is turned off and works in a reverse bias during the second time period T2 while the fourth switch $SW_4$ in the pull-up circuit 13 is turned off and works in a reverse bias during the fourth time period T4. As shown in FIG. 3B, the second time period T2 and the fourth time period T4 are longer than the first time period T1 and the third time period T3, so it indicates that the fourth switch $SW_4$ and the fifth switch $SW_5$ each will work in the reverse bias for a relatively long time. Therefore, the pixel circuit 1' may overcome the influence caused by the capacitance frequency effect and slow down the aging of components.

As set forth above, the disclosure provides a pixel circuit. When the pixel circuit changes from the data voltage input stage to the data voltage maintaining stage, the equivalent capacitance value of the liquid crystal capacitor will increase. Herein, the voltage potential of a terminal of the liquid crystal capacitor increases or decreases in response to the liquid crystal working under the positive polarity or the negative polarity. Then, the pixel circuit uses the energy stored in the capacitors to selectively turn on a desired transistor, so as to selectively charge or discharge the liquid crystal. Therefore, the pixel circuit may be beneficial to reduce the influence of the capacitance frequency effect to the liquid crystal by timely compensating the voltage difference between the two ends of the liquid crystal capacitor.

What is claimed is:

1. A pixel circuit, comprising:

a first capacitor whose two terminals are electrically coupled to a first node and a ground end, respectively;

a first switch electrically coupled to the first node and a first data input end and configured to selectively and electrically connect the first data input end to the first node after receiving a control signal;

a liquid crystal capacitor comprising a first terminal directly coupled to a second node, and a second terminal electrically coupled to a third node;

a second switch comprising a first terminal electrically coupled to a second data input end, a second terminal directly coupled to the second node, and a control terminal for receiving the control signal, and the second switch configured to selectively and electrically connect the second data input end to the second node in response to the control signal;

a pull-up circuit comprising a pull-up control terminal electrically coupled to the first node, a first terminal electrically coupled to a node of a high voltage, and a second terminal directly coupled to the second node, and the pull-up circuit configured to be enabled or disabled according to a voltage difference between the pull-up control terminal and the second terminal;

a pull-down circuit comprising a pull-down control terminal electrically coupled to a fourth node, a third terminal directly coupled to the second node, a fourth terminal electrically coupled to the ground end, and the pull-down circuit configured to be enabled or disabled according to a voltage difference between the fourth node and the ground end;

a second capacitor whose two terminals are directly coupled to the second node and the fourth node, respectively; and a third switch electrically coupled to the fourth node and the ground end and configured to selectively and electrically connect the fourth node to the ground end in response to the control signal;

wherein a data signal is inputted from the first data input end and the second data input end;

when the third node is at a high voltage potential higher than or substantially equal to a voltage potential of the data signal, and the control signal and the data signal are high, the first, second and third switches are turned on in response to the control signal and the first, second and liquid crystal capacitors are charged by the data signal;

wherein a voltage potential of the first node and a voltage potential of the second node increase to the voltage potential of the data signal, and the fourth node is coupled to a ground end.

2. The pixel circuit according to claim 1, wherein, when the high voltage potential of the third node is higher than or substantially equal to the voltage potential of the data signal, the control signal and the data signal change from high to low and the third node is at the high voltage potential, the first, second and third switches are turned off, an equivalent capacitance value of the liquid crystal capacitor becomes greater, and the voltage potential of the second node becomes higher.

3. The pixel circuit according to claim 2, wherein the pull-down circuit is configured to discharge a voltage on the liquid crystal capacitor to the ground end according to a voltage difference between the fourth node and the ground end.

4. The pixel circuit according to claim 3, wherein the voltage potential of the first node keeps at the voltage potential of the data signal, the voltage potential of the second node is discharged to a stable-status voltage, the stable-status voltage is substantially the voltage potential of the data signal plus an offset voltage, and the voltage potential of the fourth node is substantially equal to the offset voltage.

5. A pixel circuit, comprising:

a first capacitor whose two terminals are electrically coupled to a first node and a ground end, respectively;

a first switch electrically coupled to the first node and a first data input end and configured to selectively and electrically connect the first data input end to the first node after receiving a control signal;

a liquid crystal capacitor whose two terminals are electrically coupled to a second node and a third node, respectively;

a second switch electrically coupled to the second node and a second data input end and configured to selectively and electrically connect the second data input end to the second node in response to the control signal;

a pull-up circuit comprising a pull-up control terminal electrically coupled to the first node, a first terminal electrically coupled to a node of a high voltage, and a second terminal electrically coupled to the second node, and the pull-up circuit configured to be enabled or disabled according to a voltage difference between the pull-up control terminal and the second terminal;

a pull-down circuit comprising a pull-down control terminal electrically coupled to a fourth node, a third terminal electrically coupled to the second node, a fourth terminal electrically coupled to the ground end, and the pull-down circuit configured to be enabled or disabled according to a voltage difference between the fourth node and the ground end;

a second capacitor whose two terminals are electrically coupled to the second node and the fourth node, respectively; and a third switch electrically coupled to the fourth node and the ground end and configured to selectively and electrically connect the fourth node to the ground end in response to the control signal;

wherein the first data input end and the second data input end are configured to receive a data signal;

wherein when the third node is at a low voltage potential lower than or substantially equal to a voltage potential of the data signal, and the control signal and the data signal are high, the first switch, the second switch and the third switch are turned on in response to the control signal and the first, second and liquid crystal capacitors are charged by the data signal;

wherein a voltage potential of the first node and a voltage potential of the second node are charged to a voltage potential substantial equal to the voltage potential of the data signal, and the fourth node is electrically coupled to the ground end.

6. The pixel circuit according to claim 5, wherein when the low voltage potential of the third node is lower than or substantially equal to the voltage potential of the data signal, the control signal and the data signal change from high to low and the third node is at the low voltage potential, the first, second and third switches are turned off, an equivalent capacitance value of the liquid crystal capacitor becomes greater, and the voltage potential of the second node and a voltage potential of the fourth node become lower.

7. The pixel circuit according to claim 6, wherein the pull-up circuit is configured to charge the liquid crystal capacitor with the high voltage according to a voltage difference between the first node and the second node.

8. The pixel circuit according to claim 7, wherein the voltage potential of the first node substantially keeps at the voltage potential of the data signal, the voltage potential of the second node is charged to a stable-status voltage that is substantially equal to the voltage potential of the data signal minus an offset voltage, and the voltage potential of the fourth node is substantially equal to a polar inversion of the offset voltage.

* * * * *